US008767582B2

(12) United States Patent
Huang et al.

(10) Patent No.: US 8,767,582 B2
(45) Date of Patent: Jul. 1, 2014

(54) ANTENNA ARRAY CONTROL METHOD AND ACCESS POINT USING THE SAME

(75) Inventors: An Huang, Nanchong (CN); Kai-Ge Liu, Luoyang (CN); Xiang-Ming Ye, Beijing (CN)

(73) Assignees: Lite-On Electronics (Guangzhou) Limited, Guangzhou (CN); Lite-On Technology Corporation, Taipei (TW)

( * ) Notice: Subject to any disclaimer, the term of this patent is extended or adjusted under 35 U.S.C. 154(b) by 132 days.

(21) Appl. No.: 13/457,450

(22) Filed: Apr. 26, 2012

(65) Prior Publication Data

US 2013/0176870 A1 Jul. 11, 2013

(30) Foreign Application Priority Data

Jan. 9, 2012 (CN) ..... 2012 1 0003562

(51) Int. Cl.
*G08C 15/00* (2006.01)

(52) U.S. Cl.
USPC ..... 370/252

(58) Field of Classification Search
None
See application file for complete search history.

(56) References Cited

U.S. PATENT DOCUMENTS

| | | | | |
|---|---|---|---|---|
| 6,031,831 | A * | 2/2000 | Tan Boon et al. | 370/342 |
| 2006/0171357 | A1 * | 8/2006 | King et al. | 370/331 |
| 2007/0002892 | A1 * | 1/2007 | Waxman | 370/465 |
| 2011/0151931 | A1 * | 6/2011 | Kish et al. | 455/562.1 |

FOREIGN PATENT DOCUMENTS

| | | | |
|---|---|---|---|
| JP | 2008-270940 | A | 11/2008 |
| WO | WO02/19740 | A1 | 3/2002 |
| WO | WO2004/114459 | A2 | 12/2004 |
| WO | WO2005/089358 | A2 | 9/2005 |
| WO | WO2006031495 | A2 | 3/2006 |
| WO | WO2010023890 | A1 | 3/2010 |

* cited by examiner

*Primary Examiner* — Chi Pham
*Assistant Examiner* — Raul Rivas
(74) *Attorney, Agent, or Firm* — Li & Cai Intellectual property (USA) Office

(57) ABSTRACT

The present disclosure provides an antenna array control method and an access point using the same. The antenna array control method may include the following steps. At least a packet is selected as at least a probing packet every probing period. One of the radiation patterns to be probed in an antenna array is used to transmit the probing packet. The packet error rates of the radiation patterns to be probed in the antenna array are calculated. The radiation pattern with a minimum packet error rate among all of the radiation patterns is selected as a best radiation pattern.

9 Claims, 4 Drawing Sheets

| RSSI variation | statistic attenuation value | probing period | probing range |
|---|---|---|---|
| no variation | attenuate 1/8 | standard period T | P/8 |
| little variation | attenuate 1/4 | T/2 | P/4 |
| normal variation | attenuate 1/2 | T/3 | P/2 |
| extreme variation | discard all | T/4 | all radiation patterns P |

FIG. 4

ANTENNA ARRAY CONTROL METHOD AND ACCESS POINT USING THE SAME

BACKGROUND

1. Technical Field

The present disclosure relates to an antenna array control method, in particular, to an antenna array control method for selecting a best radiation pattern to perform a communication, and the access point using the same.

2. Description of Related Art

Recently, the wireless communication technology develops rapidly, and thus the client can communicate with the access point served as the wireless hotspot, such as Wireless Fidelity (Wi-Fi) hotspot, to share data and browse the web page. The client is for example a smart phone, a pad, a notebook, or any other mobile device having the communication ability. The access point is for example a smart phone served as the mobile station, an indoor access point, an outdoor access point, or any other communication device allowing the client to establish a link to access the internet.

The radiation strength of the omni-directional antenna is distributed uniformly for all directions (or angles), and thus each of the most conventional access points adopts the omni-directional antenna to communicate with the clients of the different directions. Unfortunately, the omni-directional antenna has the dispersed antenna radiation energy, the low radiation efficiency, and the limited coverage.

For each of specific directions, the directional antenna has stronger radiation strength and the farer coverage. Thus, in order to increase the efficiency of antenna radiation energy and the coverage, each of some conventional access points adopts the directional antennae to communicate with the clients of the different directions. However, the conventional access point of this type, must know the specific position of the client during wireless communication, and the antenna array must be manually configured, such that the conventional access point can use the matched radiation pattern to communicate with the client.

In short, most conventional access points themselves are multiple input multiple output (MIMO) systems, and can select a best radiation pattern by using a conventional antenna array control method to communicate with the client of the specific direction. In other words, the beam forming is performed by the conventional access points. It is a pity that the conventional antenna array control method has the longer executing time and lower accuracy.

SUMMARY

An exemplary embodiment of the present disclosure discloses an antenna array control method comprising the following steps. At least a packet is selected as at least a probing packet every probing period. One of the radiation patterns to be probed in an antenna array is used to transmit the probing packet. Packet error rates of the radiation patterns to be probed in the antenna array are calculated. The radiation pattern with a minimum packet error rate among all of the radiation patterns is selected as a best radiation pattern.

An exemplary embodiment of the present disclosure discloses an antenna array control method comprising the following steps. Whether a plurality of radiation patterns to be probed of an antenna array must be probed or not is determined, so as to choose at least a packet as at least a probing packet. If the radiation patterns to be probed of the antenna array must be probed, whether a minimum probing packet transmitting number of the radiation patterns to be probed is less than a probing packet transmitting window value is determined. If the minimum probing packet transmitting number of the radiation patterns to be probed is less than the probing packet transmitting window value, the antenna array is controlled to use the radiation pattern with the minimum probing packet transmitting number to transmit the probing packet. If the minimum probing packet transmitting number of the radiation patterns to be probed is not less than the probing packet transmitting window value, the probing packet transmitting numbers of the radiation patterns to be probed are attenuated, the antenna array is controlled to use the radiation pattern with a minimum packet error rate to transmit the probing packet, and a best radiation pattern is set to be the radiation pattern with the minimum packet error rate.

An exemplary embodiment of the present disclosure discloses an access point comprising an antenna array, a radiation pattern controller, a radio frequency (RF) circuit, and an antenna array control method execution unit. The radiation pattern controller is electrically coupled to the antenna array, the radio frequency circuit is electrically coupled to the antenna array, and the antenna array control method execution unit is electrically coupled to the radio frequency circuit and the radiation pattern controller. The antenna array has a plurality of radiation patterns. The radiation pattern controller is used to select one of the radiation patterns of the antenna array according to a radiation pattern selection signal. The antenna array control method execution unit is used to select at least a packet as at least a probing packet every probing period, control the access point to use one of the radiation patterns to be probed to transmit the probing packet through generating the radiation pattern selection signal, calculate packet error rates of the radiation patterns to be probed, and control the access point to select the radiation pattern with a minimum packet error rate among all of the radiation patterns as a best radiation pattern of the antenna array.

To sum up, the antenna array control method and access point according to exemplary embodiments of the present disclosure can fast and accurately find the best radiation pattern which is used to communicate with client.

In order to further understand the techniques, means and effects the present disclosure, the following detailed descriptions and appended drawings are hereby referred, such that, through which, the purposes, features and aspects of the present disclosure can be thoroughly and concretely appreciated; however, the appended drawings are merely provided for reference and illustration, without any intention to be used for limiting the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

FIG. 4 is a table of the relation among the received signal strength indicator (RSSI) variation, the statistic attenuation value, the probing period, and the probing range of the radiation patterns to be probed according to an exemplary embodiment of the present disclosure.

DESCRIPTION OF THE EXEMPLARY EMBODIMENTS

Figure 1:
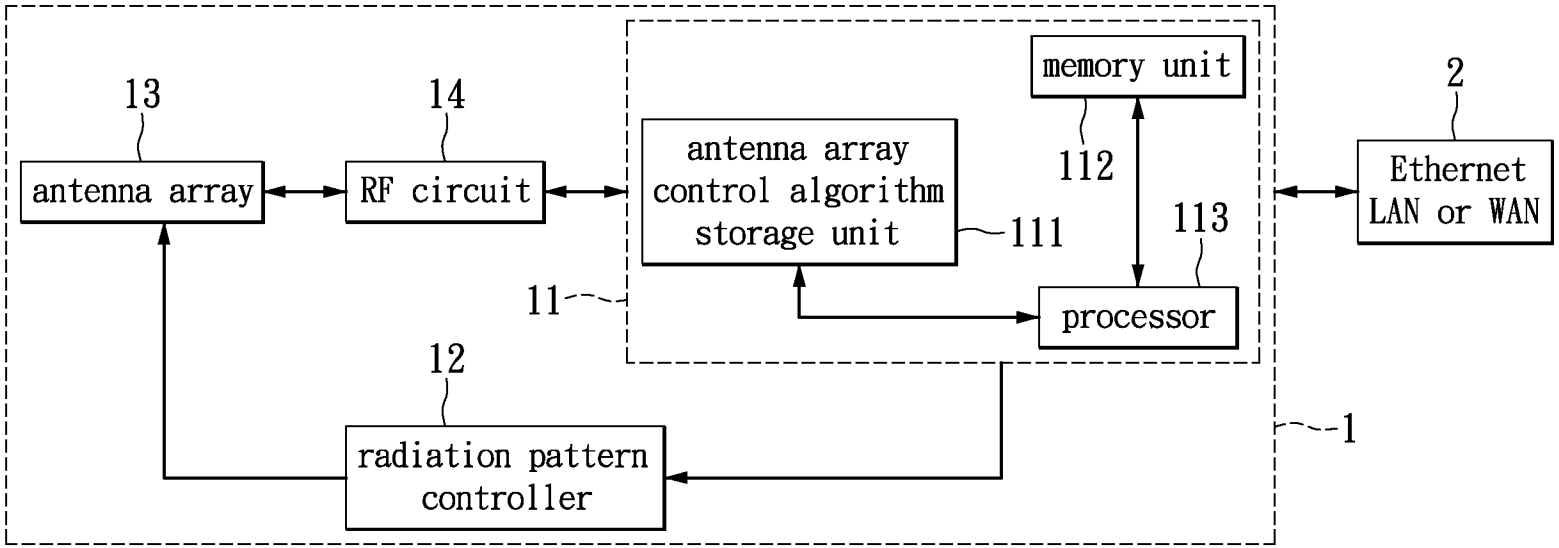
FIG. 1 is block diagram of an access point according to an exemplary embodiment of the present disclosure.

Reference will now be made in detail to the exemplary embodiments of the present disclosure, examples of which are illustrated in the accompanying drawings. Wherever possible, the same reference numbers are used in the drawings and the description to refer to the same or similar parts.

An exemplary embodiment of the present disclosure provides an access point of executing an antenna array control method, such that the access point can use the best radiation pattern to communicate with the client. The antenna array control method periodically chooses a packet to be transmitted as a probing packet to find the packet error rates of the radiation patterns to be probed, and determines a probing range of the radiation patterns to be probed (i.e. the set of the radiation patterns to be probed), a probing period, and a statistic range of the packet error rate (i.e. the total sample number of the packet error rate, which is corresponding to a statistic attenuation value) by performing a statistic operation on the received signal strength indicator (RSSI) variation associated with the best radiation pattern.

In short, the antenna array control method utilizes the statistic information of the transmission, such as the packet error rates of the radiation patterns to be probed, the received signal strength indicator variation of the best radiation pattern, and so on. Thus, the accuracy and execution time of the antenna array control method for finding the best radiation pattern are respectively increased and shortened. In addition, the throughput of the access point using the above antenna array control method can be further enhanced. The following descriptions illustrate the details of the exemplary embodiments of the access point and the antenna array control method.

Exemplary Embodiment of Access Point

FIG. 1 is a block diagram of an access point according to an exemplary embodiment of the present disclosure. The access point 1 is linked to the internet services provider (ISP) through the Ethernet local area network or wide area network (Ethernet LAN or WAN) 2, and the client (not shown in FIG. 1) can communicate with the access point 1 to share data or browse the web page. In addition, for each client, the access point 1 can find the best radiation pattern among the plurality of the radiation patterns to communicate with the client. Thus, the access point 1 in fact is a multiple input multiple output system with the beam forming technology. The access point 1 is for example a multiple input multiple output outdoor or indoor access point with the beam forming technology.

The access point 1 comprises an antenna array control method execution unit 11, a radiation pattern controller 12, an antenna array 13, and radio frequency circuit 14. The antenna array control method execution unit 11 is electrically coupled to the radiation pattern controller 12. The radiation pattern controller 12 is electrically coupled to the antenna array 13. The antenna array 13 is electrically coupled to the radio frequency circuit 14. The radio frequency circuit 14 is electrically coupled to the antenna array control method execution unit 11.

The antenna array control method execution unit 11 comprises an antenna array control algorithm storage unit 111, a memory unit 112, and a processor 113. The processor 113 is electrically coupled to the antenna array control algorithm storage unit 111 and the memory unit 112.

The antenna array control algorithm storage unit 111 stores an algorithm associated with the antenna array control method, and for example can be the non-volatile memory apparatus. The processor 113 performs the antenna array control method according to the algorithm stored in the antenna array control algorithm storage unit 111, and transmits the statistic information (such as packet error rates of the radiation pattern, the packet transmitting number, a received signal strength indicator of each packet, and a received signal strength indicator variation and sample number of the best radiation pattern) obtained from the execution of the antenna array control method to the memory unit 112. The memory unit 112 stores the statistic information, and can for example be a volatile or non-volatile memory apparatus.

In the exemplary embodiment of FIG. 1, the antenna array control method is implemented by a firmware or software. However, it is noted that the present disclosure is not limited thereto. In other words, the antenna array control method execution unit 11 can be implemented in a software, firmware, or hardware based manner.

The antenna array 13 has a plurality of antennas which provides a plurality of radiation patterns to the radio frequency circuit 14, and thus the radio frequency circuit 14 can use selected one of the radiation patterns to transmit or receive the packet. The radiation pattern controller 12 indicates the antenna array 13 to select one of the radiation patterns according to the radiation pattern selection signal generated by antenna array control method execution unit 11.

The antenna array control method execution unit 11 selects at least a packet as at least a probing packet every probing period, and use one of the radiation patterns to be probed to transmit the probing packet. In addition, the other packets not selected as the probing packets are transmitted by using the best radiation pattern. Furthermore, in the exemplary embodiment of the present disclosure, the antenna array 13 may set the radiation pattern for receiving the packet to be the radiation pattern for transmitting the packet.

According to the majority of communications standards, when the client receives a packet, the client will transmit a confirm signal (for example, the acknowledge signal ACK) back to the access point 1, or equivalently, when the client does not receive the packet for a specific time, the client will transmit the non-confirm signal (for example, the non-acknowledge signal NACK) back to the access point 1. Thus, the access point 1 can know whether the probing packet is successfully transmitted to the client or not, and the antenna array control method execution unit 11 can further obtain the packet error rates of the radiation patterns to be probed.

To be specific, to enhance the comparability of the packet error rates, the antenna array control method execution unit 11 can make the probing packet transmitting numbers of radiation patterns to be probed be identical to each other. During the probing process, the antenna array control method execution unit 11 selects the radiation pattern to be probed with the minimum probing packet transmitting number to transmit the probing packet. Then, the antenna array control method execution unit 11 generates the radiation pattern selection signal corresponding to the radiation pattern to be probed with the minimum probing packet transmitting number to the radiation pattern controller 12. Thus, the radiation pattern controller 12 can control the antenna array 13 to select the radiation pattern to be probed with the minimum probing packet transmitting number.

When the probing packet transmitting numbers of the radiation patterns to be probed are equal to the probing packet transmitting window value (i.e. a specific threshold value), the antenna array control method execution unit 11 may reset the probing packet transmitting numbers of the radiation patterns to be probed, and select the radiation pattern with the minimum packet error rate among the radiation patterns as the best radiation pattern. Then, the antenna array control method execution unit 11 may generate the radiation pattern selection signal corresponding to the best radiation pattern to the radiation pattern controller 12, such that the radiation pattern controller 12 can control the antenna array 13 to select the radiation pattern.

It is noted that, the antenna array control method execution unit 11 attenuates the probing packet transmitting numbers of the radiation patterns to be probed according to the statistic attenuation value to reset the probing packet transmitting numbers of the radiation patterns to be probed.

In addition, when the antenna array control method execution unit 11 currently uses the best radiation pattern to transmit the probing packet, the antenna array control method execution unit 11 can perform a statistic operation on the received signal strength indicator of each probing packet. When the sample number of the received signal strength indicators being counted is enough, the antenna array control method execution unit 11 calculates the received signal strength indicator variation of the best radiation patterns according to the received signal strength indicators.

When the antenna array control method execution unit 11 currently does not use best radiation pattern to transmit the probing packet, if the best radiation pattern does not change, the antenna array control method execution unit 11 cannot calculate the received signal strength indicator variation of the currently used radiation pattern. By contrast, if the best radiation pattern changes, the antenna array control method execution unit 11 can calculate the received signal strength indicator variation of the best radiation pattern of the previously used best radiation pattern so as to obtain the statistic attenuation value, the probing period, and the probing range of the radiation patterns to be probed. Then, the antenna array control method execution unit 11 can reset the received signal strength indicator variation of the best radiation pattern.

Based upon the foregoing description, in the exemplary embodiment of the present disclosure, the antenna array control method executed by the antenna array control method execution unit 11 can be divided into two main steps which are respectively the probing packet transmission step and the probing packet statistic calculation step. The following description gives illustrations of the probing packet transmission step and the probing packet statistic calculation step.

Figure 2:
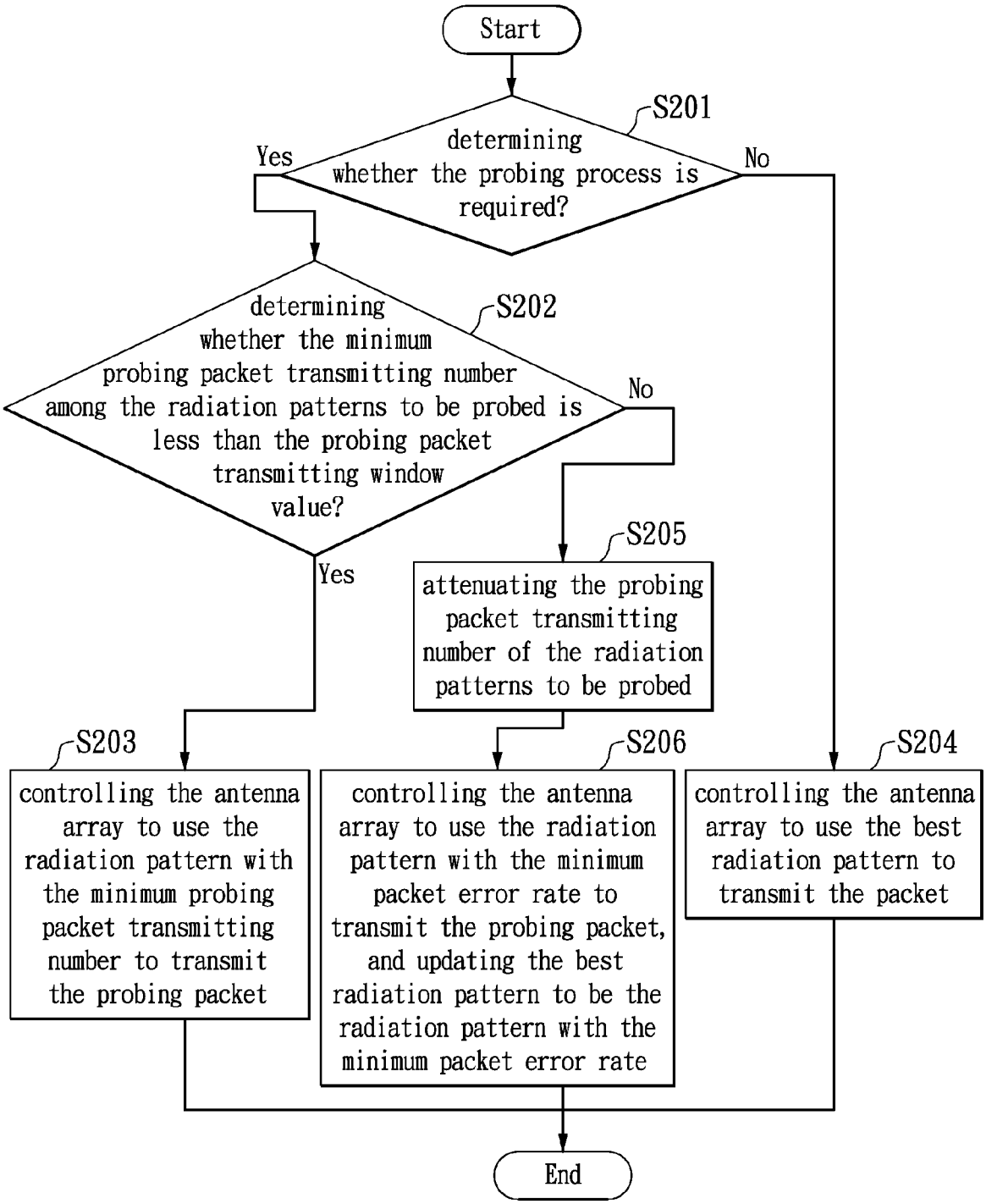
FIG. 2 is a flow chart of the probing packet transmission step of the antenna array control method according to an exemplary embodiment of the present disclosure.

Exemplary Embodiment Probing Packet Transmission Step of Associated with Antenna Array Control Method Referring to FIG. 1 and FIG. 2, FIG. 2 is a flow chart of the probing packet transmission step of the antenna array control method according to an exemplary embodiment of the present disclosure. First, at step S201, the antenna array control method execution unit 11 determines whether the probing process is required. If the probing process is required, the step S202 is then executed. If the probing process is not required, the step S204 is then executed. As described above, the antenna array control method selects at least a packet as at least a probing packet to be transmitted every probing period, and thus whether a next probing period is reached is used to determine whether the probing process is required.

At step S204, since the probing process is not required (i.e. the packet is not served as the probing packet), the antenna array control method execution unit 11 controls the antenna array 13 to use the best radiation pattern to transmit the packet through the radiation pattern controller 12. At step S204, the antenna array control method execution unit 11 further sets the best radiation pattern to be the radiation pattern of the antenna array for receiving the packet.

At step S202, the antenna array control method execution unit 11 determines whether the minimum probing packet transmitting number among the radiation patterns to be probed is less than the probing packet transmitting window value. If the minimum probing packet transmitting number is less than the probing packet transmitting window value, the step S203 is executed. If the minimum probing packet transmitting number is equal to the probing packet transmitting window value (i.e. the probing packet transmitting number of the radiation patterns to be probed are equal to the probing packet transmitting window value), the step S205 is executed.

At step S203, the antenna array control method execution unit 11 determines the antenna array 13 to use the radiation pattern with the minimum probing packet transmitting number to transmit the probing packet through the control of the radiation pattern controller 12. In addition, at step S203, the antenna array control method execution unit 11 further sets the radiation pattern of the antenna array 13 for receiving the packet to be the radiation pattern with the minimum probing packet transmitting number.

At step S205, the antenna array control method execution unit 11 attenuates the probing packet transmitting number of the radiation patterns to be probed according to the statistic attenuation number. Next, at step S206, the antenna array control method execution unit 11 determines the antenna array 13 to use the radiation pattern with the minimum packet error rate to transmit the probing packet through the control of the radiation pattern controller 12, and updates the best radiation pattern to be the radiation pattern with the minimum packet error rate. In addition, at step S206, the antenna array control method execution unit 11 further sets the radiation pattern of the antenna array 13 for receiving the packet to be the radiation pattern with the minimum packet error rate.

Moreover, it is noted that, the probing range of the radiation patterns to be probed, the probing period, and the statistic attenuation value is determined according to the received signal strength indicator variation of the best radiation pattern. When the received signal strength indicator variation of the best radiation pattern is smaller, the probing range of the radiation to be probed and the statistic attenuation value is smaller, and the probing period is longer. By contrast, when the received signal strength indicator variation of the best radiation pattern is larger, the probing range of the radiation to be probed and the statistic attenuation value is larger, and the probing period is shorter. Thus, the accuracy of the antenna array control method is guaranteed, and the execution time and the probing consumption are reduced.

Figure 3:
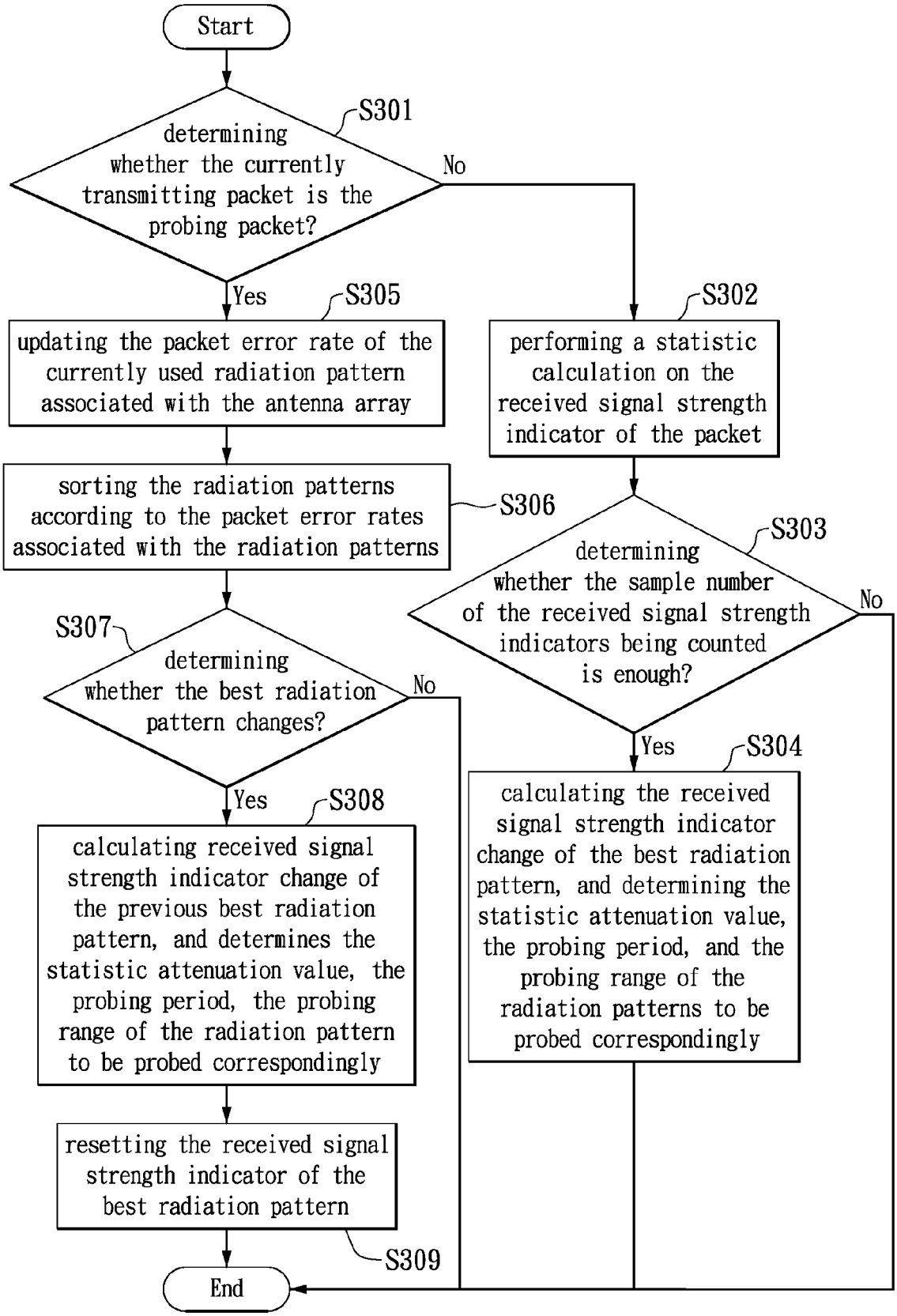
FIG. 3 is a flow chart of the probing packet statistic calculation step of the antenna array control method according to an exemplary embodiment of the present disclosure.

Exemplary Embodiment of Probing Packet Statistic Calculation Step associated with Antenna Array Control Method Please refer to FIG. 1 and FIG. 3. FIG. 3 is a flow chart of the probing packet statistic calculation step of the antenna array control method according to an exemplary embodiment of the present disclosure. After the access point 1 transmits the probing packet, the antenna array control method execution unit 11 may further execute the probing packet statistic calculation step, so as to obtain the received signal strength indicator variation of the best radiation pattern, and dynamically adjust the probing range of the radiation patterns to be probed, the probing period, and statistic attenuation value according to the received signal strength indicator variation of the best radiation pattern.

First, at step S301, antenna array control method execution unit 11 determines whether the currently transmitting packet is the probing packet. If the currently transmitting packet is not the probing packet, the step S302 will be executed. If the currently transmitting packet is the probing packet, the step S305 will be executed.

At step S302, the antenna array control method execution unit 11 performs a statistic calculation on the received signal strength indicator of the packet. Then, at step S303, the antenna array control method execution unit 11 determines whether the sample number of the received signal strength indicators being counted is enough. If the sample number of the received signal strength indicators being counted is enough, the step S304 will be executed. If the sample number of the received signal strength indicators being counted is not enough, the probing packet statistic calculation step will be ended. It is noted that, at step S303, whether the sample number of the received signal strength indicators being counted is enough can be determined by whether the statistic period used to perform the statistic calculation on the received signal strength indicator.

At step S304, the antenna array control method execution unit 11 calculates the received signal strength indicator variation of the best radiation pattern, and determines the statistic attenuation value, the probing period, and the probing range of the radiation patterns to be probed correspondingly, wherein the received signal strength indicator variation of the best radiation pattern is obtained according to the received signal strength indicators of the packets transmitted by using the best radiation pattern.

At step S305, the antenna array control method execution unit 11 updates the packet error rate of the currently used radiation pattern associated with the antenna array 13. At step S306, the antenna array control method execution unit 11 sorts the radiation patterns according to the packet error rates associated with the radiation patterns.

Next, at step S307, the antenna array control method execution unit 11 determines whether the best radiation pattern changes, i.e. determines whether the radiation pattern with the minimum packet error rate is still the previous best radiation pattern. If the best radiation pattern changes, the step S308 will be executed. By contrast, if the best radiation pattern doesn't change, the probing packet statistic calculation step will be ended.

At step S308, the antenna array control method execution unit 11 calculates received signal strength indicator variation of the previous best radiation pattern, and determines the statistic attenuation value, the probing period, the probing range of the radiation pattern to be probed correspondingly, wherein the received signal strength indicator variation of the previous best radiation pattern is obtained according to the received signal strength indicators of the packets transmitted by the previous best radiation pattern. Next, at step S309, the antenna array control method execution unit 11 resets the received signal strength indicator of the best radiation pattern, so as to recalculate the received signal strength indicator variation of the best radiation pattern.

Next, the details for determining the statistic attenuation value, the probing period, and the probing range of the radiation pattern are illustrated as follows. Referring to FIG. 4, FIG. 4 is a table of the relation among the received signal strength indicator variation, the statistic attenuation value, the probing period, and the probing range of the radiation patterns to be probed according to an exemplary embodiment of the present disclosure. As stated above, the received signal strength indicator variation of the best radiation pattern is corresponding to the received signal strength indicator variation of the best radiation pattern.

The formula of the received signal strength change of the best radiation pattern is for example can be expressed as CR=PT0/2+(CR1+CR2)/4. The variable CR represents the received signal strength change of the best radiation pattern, and the variables CR1 and CR2 respectively represent the received signal received strength indicators of the previous two best radiation patterns. The variable PT0 is expressed as $PT0=num(-r \le RSSI_k - RA1 \le r)/SampleNum$, wherein the variable SampleNum represents the sample number of the received signal strength indicator, the variable r is a user defined positive integer, such as 1, the variable RA1 represents the average received signal strength indicator in the previous statistic period, the variable $RSSI_k$ is the received signal strength indicator in the previous statistic period, and the function $num(-r \le RSSI_k - RA1 \le r)$ means the number which the difference between the received signal strength indicator and the average received signal strength indicator in the previous statistic period is not less than −r and not larger than r. In short, the variable PT0 represents the ratio of the number which the difference between the received signal strength indicator and the average received signal strength indicator in the previous statistic period is not less than −r and not larger than r, over the sample number of the received signal strength indicators.

However, it is noted that, the formula of the received signal strength indicator variation may be modified to meet the different requirements. The formula of the received signal strength indicator variation is not used to limit the present disclosure.

In the exemplary embodiment of FIG. 4, when the received signal strength indicator of the best radiation is not larger than a %, it means the received signal strength indicator variation has no variation. Meanwhile, the statistic attenuation value is ⅛, the probing range of the radiation patterns to be probed is P/8, and the probing period is T, wherein the variable a is for example 5, the variable T represents the standard period, and the variable P is the total number of all radiation pattern of the antenna array 13. Taking the case that the received signal strength indicator of the best radiation is not larger than a % for example, at step S202, the probing packet transmitting numbers of the radiation patterns to be probed are attenuated ⅛, i.e. the ⅛ statistic samples of the radiation patterns to be probed are attenuated ⅛ are discarded, and the radiation patterns to be probed are the radiation patterns with the first ⅛ small packet error rate.

When the received signal strength indicator of the best radiation is larger than a % but less than and equal to b %, it means the received signal strength indicator variation has little variation. Meanwhile, the statistic attenuation value is ¼, the probing range of the radiation patterns to be probed is P/4, and the probing period is T/2, wherein the variable b is for example 15. When the received signal strength indicator of the best radiation is larger than b % but less than and equal to c %, it means the received signal strength indicator variation has normal variation. Meanwhile, the statistic attenuation value is ½, the probing range of the radiation patterns to be probed is P/2, and the probing period is T/3, wherein the variable b is for example 45. When the received signal strength indicator of the best radiation is larger than c %, it means the received signal strength indicator variation has extreme variation. Meanwhile, the statistic attenuation value is 1, the probing range of the radiation patterns to be probed is P, and the probing period is T/4.

In addition, it is noted that the table of FIG. 4 is one exemplary embodiment of the present disclosure, and the present disclosure is not limited thereto. The comparison table among the received signal strength indicator variation, the statistic attenuation value, the probing period, and the probing range of the radiation patterns to be probed may be modified by the different requirements. Furthermore, the standard period T may be determined according to the state relation between the access point 1 and the client.

Possible Results of Exemplary Embodiment

To sum up, the antenna array control method and access point of the exemplary embodiments can fast and accurately find the best radiation pattern to communicate with the client. Furthermore, compared to the conventional access point, the access point using the above antenna array control method has the increased wireless coverage, the enhanced data throughput, and the improved data transmission rate.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An antenna array control method, comprising:

selecting at least a packet as at least a probing packet every probing period;

using one of the radiation patterns to be probed in an antenna array to transmit the probing packet;

calculating packet error rates of the radiation patterns to be probed in the antenna array; and selecting the radiation pattern with a minimum packet error rate among all of the radiation patterns as a best radiation pattern;

wherein when probing packet transmitting numbers of the radiation patterns to be probed are not equal to a probing packet transmitting window value, the radiation pattern with the minimum probing packet transmitting number is used to transmit the probing packet, wherein when the probing packet transmitting numbers of the radiation patterns to be probed are equal to the probing packet transmitting window value, the probing packet transmitting numbers of the radiation patterns to be probed are attenuated, the probing packet is transmitted by using the radiation pattern with a minimum packet error rate, and then the best radiation pattern is set to be the radiation pattern with the minimum packet error rate, and wherein a received signal strength indicator of each packet transmitted by using the best radiation pattern is calculated, a received signal strength indicator variation of the best radiation pattern is obtained according to the received signal strength indicators, and then the probing period, a statistic attenuation value, and a probing range of the radiation patterns to be probed are determined according to the received signal strength indicator variation.

2. The antenna array control method according to claim 1, further comprising:

dynamically adjusting the probing period and a probing range of the radiation patterns to be probed according to a received signal strength indicator variation.

3. The antenna array control method according to claim 1, wherein at least one packet which is not served as the probing packet is transmitted by using the best radiation pattern.

4. An antenna array control method, comprising:

determining whether a plurality of radiation patterns to be probed of an antenna array must be probed or not, so as to choose at least a packet as at least a probing packet;

if the radiation patterns to be probed of the antenna array must be probed, determining whether a minimum probing packet transmitting number of the radiation patterns to be probed is less than a probing packet transmitting window value;

if the minimum probing packet transmitting number of the radiation patterns to be probed is less than the probing packet transmitting window value, controlling the antenna array to use the radiation pattern with the minimum probing packet transmitting number to transmit the probing packet;

if the minimum probing packet transmitting number of the radiation patterns to be probed is not less than the probing packet transmitting window value, attenuating the probing packet transmitting numbers of the radiation patterns to be probed, controlling the antenna array to use the radiation pattern with a minimum packet error rate to transmit the probing packet, and setting a best radiation pattern to be the radiation pattern with the minimum packet error rate; and if the radiation patterns to be probed of an antenna array must not be probed, using the best radiation pattern to transmit at least a packet which is not served as the probing packet;

determining whether the packet is served as the probing packet;

if the packet is not served as the probing packet, calculating a received signal strength indicator of the packet transmitted by using the best radiation pattern;

determining whether a sample number of the received signal strength indicators being counted is enough;

if the sample number of the received signal strength indicators being counted is enough, obtaining a received signal strength indicator variation of the best radiation pattern according to the received signal strength indicators, and determining the probing period, a probing range of the radiation pattern to be probed, and statistic attenuation value according to the received signal strength indicator variation of the best radiation pattern.

5. The antenna array control method according to claim 4, wherein whether a next probing period is reached is judged to determine whether the radiation patterns to be probed of an antenna array must be probed or not.

6. The antenna array control method according to claim 4, further comprising:

if the packet is served as the probing packet, updating the packet error of the currently used radiation pattern;

sorting the radiation patterns according to the packet error rates;

determining whether the best radiation pattern changes;

if the best radiation pattern changes, using the received signal strength indicator variation of the previously used radiation pattern used to transmit the packets to determine the probing period, the probing range of the radiation pattern to be probed, and statistic attenuation value; and resetting the received signal strength indicator variation of the best radiation pattern used by the probing packets.

7. An access point, comprising:

an antenna array, having a plurality of radiation patterns;

a radiation pattern controller, electrically coupled to the antenna array, used to select one of the radiation patterns of the antenna array according to a radiation pattern selection signal;

a radio frequency circuit, electrically coupled to the antenna array;

an antenna array control method execution unit, electrically coupled to the radio frequency circuit and the radiation pattern controller, used to select at least a packet as at least a probing packet every probing period, control the access point to use one of the radiation patterns to be probed to transmit the probing packet through generating the radiation pattern selection signal, calculate packet error rates of the radiation patterns to be probed, and control the access point to select the radiation pattern with a minimum packet error rate among all of the radiation patterns as a best radiation pattern of the antenna array through generating the radiation pattern selection signal;

wherein when probing packet transmitting numbers of the radiation patterns to be probed are not equal to a probing packet transmitting window value the antenna array control method execution unit controls the access point to use the radiation pattern with a minimum probing packet transmitting number to transmit the probing packet through generating the radiation pattern selection signal, wherein when the probing packet transmitting numbers of the radiation patterns to be probed are equal to the probing packet transmitting window value, the antenna array control method execution unit attenuates the probing packet transmitting numbers of the radiation patterns to be probed, and the antenna array control method execution unit controls the access point to use the radiation pattern with the minimum packet error rate to transmit the probing packet through generating the radiation pattern selection signal, and sets a best radiation pattern to be the radiation pattern with the minimum packet error rate, wherein the antenna array control method execution unit calculates a received signal strength indicator of each packet transmitted by using the best radiation pattern, obtains a received signal strength indicator variation of the best radiation pattern according to the received signal strength indicators, and then determines the probing period, a statistic attenuation value, and a probing range of the radiation patterns to be probed according to the received signal strength indicator variation.

8. The access point according to claim 7, wherein the antenna array control method execution unit further dynamically adjusts the probing period and a probing range of the radiation patterns to be probed according to a received signal strength indicator variation of the best radiation pattern of the antenna array.

9. The access point according to claim 7, wherein for at least one packet which is not served as the probing packet, the antenna array control method execution unit controls the access point to use the best radiation pattern to transmit the packet through generating the radiation pattern selection signal.

* * * * *